United States Patent [19]

Fritsch et al.

[11] Patent Number: 4,865,528

[45] Date of Patent: Sep. 12, 1989

[54] METHOD AND ARRANGEMENT FOR STARTING AN HYDRAULIC DIAPHRAGM PUMP AGAINST LOAD

[75] Inventors: Horst Fritsch, Leonberg; Josef Jarosch, Stutgart, both of Fed. Rep. of Germany

[73] Assignee: Lewa Herbert Ott GmbH & Co., Fed. Rep. of Germany

[21] Appl. No.: 170,149

[22] Filed: Mar. 18, 1988

[30] Foreign Application Priority Data

Mar. 18, 1987 [DE] Fed. Rep. of Germany ..... 3708868

[51] Int. Cl.[4] ..... F04B 43/06

[52] U.S. Cl. ..... 417/388; 417/385

[58] Field of Search ..... 417/388, 385, 386, 387, 417/383

[56] References Cited

U.S. PATENT DOCUMENTS 3,433,161 3/1969 Vetter ..... 417/388

FOREIGN PATENT DOCUMENTS 1653512 8/1970 Fed. Rep. of Germany ..... 417/388

48508 8/1985 Japan ..... 417/387

*Primary Examiner*—Leonard E. Smith

*Attorney, Agent, or Firm*—Bierman and Muserlian

[57] ABSTRACT

In a diaphragm pump, which is provided with at least one diaphragm (1), which separates a delivery chamber (4) from a pressure chamber (5) filled with an hydraulic fluid and is clmaped at its edge between the pump body (2) and a pump cover (3), and with an hydraulic diaphragm drive in the form of an oscillating displacement piston (6), which is displaceable in the pump body (2) between the pressure chamber (5) and a storage chamber (7) for the hydraulic fluid, a method as well as an arrangement for starting under load is provided. For this purpose on the pump drive side between the pressure chamber (5) and the storage chamber (7) a connection channel (20) is provided. This connection channel (20) during start-up of the pump leads the hydraulic fluid displaced by the displacement piston (6) in the pressure chamber (5) back into the storage chamber (7) and in the course of the further strokes of the displacement piston (6) is closable by a controlled closing device (A), so that the pressure in the pressure chamber (5) rises up to the level of the discharge pressure.

21 Claims, 5 Drawing Sheets

METHOD AND ARRANGEMENT FOR STARTING AN HYDRAULIC DIAPHRAGM PUMP AGAINST LOAD

Figure 1:
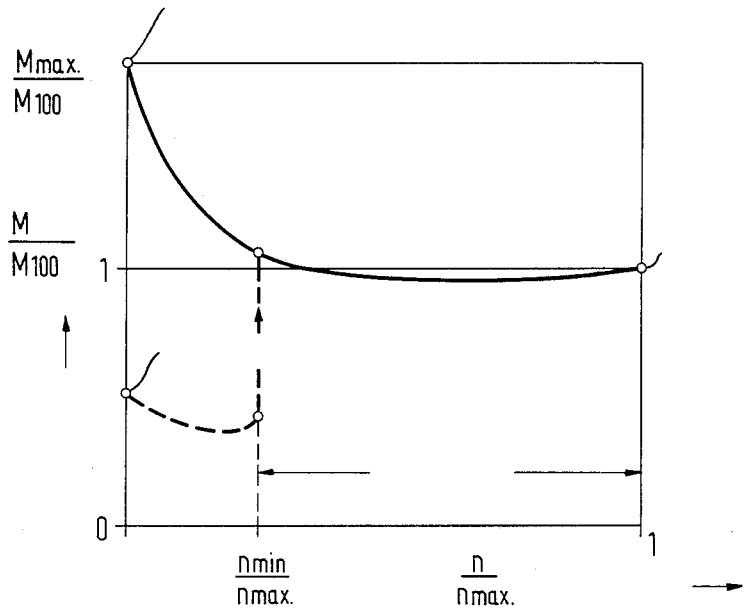

The invention relates to a method for starting an hydraulic diaphragm pump against load with the actuation of a diaphragm separating a delivery chamber from an hydraulic pressure chamber taking place by an oscillating displacement piston which is displacable between the pressure chamber and the hydraulic supply. The invention, in addition, pertains to an arrangement provided for carrying out this method with a diaphragm pump being provided with at least one diaphragm separating a delivery chamber from a pressure chamber filled with hydraulic fluid and is clamped at its edge between the pump body and the pump cover and with a hydraulic diaphragm drive in the form of an oscillating displacement piston which is displacable between the pressure chamber and a supply chamber for the hydraulic fluid.

If an hydraulic diaphragm pump i.e. an oscillating displacement pump under load, which means under full system pressure, must be started. The first thing that needs to be overcome is the so-called breakaway momentum. This is of the order of magnitude of twice the nominal momentum, which necessitates that the pump drive must be layed out correspondingly. However, so that the drive need not be too strongly overdimensioned, in such cases, in particular with large three-plunger pumps, use is made of installing a so-called starting circuit on the product side, i.e. the delivery side of the pump. This necessitates, however, application of several actuating valves in connection with a special control device. For high discharge pressures, therefore, such starting circuits are very expensive and not without problems, especially when difficult delivery fluids, for example, suspensions are involved.

The invention is based on the task of creating—in order to eliminate the described disadavantages—a method as well as an arrangement, which operates reliably with low constructional expenditure and permits smooth starting of the diaphragm pump under load without the drive needing to be layed out for the high breakaway momentum.

This task is solved with the method according to the invention. Advantageous designs of this method are described in the specification.

The features of the arrangement developed in the form of a starting device, according to the invention, are evident. Useful further developments of it are explained in the additional claims.

The method according to the invention consists in that during the start of the diaphragm pump initially a stroke volume of the hydraulic fluid is transported in an open connection path between pressure chamber and supply chamber and this transport can be a circulation flow or pulsation; subsequently, the motion of the diaphragm is coupled to the displacement of the displacement piston in that the connection between pressure chamber and supply chamber is interrupted. This increases the pressure in the pressure chamber to the level of the discharge pressure, so that the pump is smoothly connected into the pressure system of the installation. The interruption of the connection between pressure chamber and supply chamber is controlled, with a preferred design of the method being an automatic interruption of this connection. In this case, according to the invention, provisions can be made of effecting the interruption of the connection through the excess pressure of the hydraulic fluid occuring in the pressure chamber during the compression stroke.

The invention is based on the essential concept of shifting the starting device from the product side the oil side, i.e. hence, from the discharge side to the drive side and for this purpose provide between the pressure chamber and the supply chamber a connection channel, which basically is open, however, after starting operation of the pump slowly or also rapidly is closed, which subsequently increases the pressure in the pressure chamber up to the level of discharge pressure. The requisite breakaway momentum, consequently, amounts to only a fraction of what it would be without starting device, so that the decisive advantage is brought about that the pump drive essentially only needs to be layed out for the nominal momentum, not, however, for the breakaway momentum. This has the further advantage that the drive motor layed out for the nominal momentum operates with a significantly better degree of effectiveness than the otherwise required drive motor adapted to the breakaway momentum and, hence, of much greater dimensions.

The closing device, with which the connection channel can be closed gradually, has, according to the invention, a movable closing body. This can have, within the frame of the invention, different constructional forms, specifically, in the form of a valve, a spool valve, a piston valve or similar.

The closing body is preferentially arranged in a connecting bore accessible from the outside, which expediently is provided in a bend of the connection channel, so that two partial sections of the connection channel are formed, specifically a channel section on the pressure chamber side as well as one on the supply room side, which are connected through the connecting bore.

According to the invention, the closing body of the closing device can be actuated from the outside by way of an actuating drive, be it electric, magnetic or pneumatic. The actuating drive can operate as a function of the number respectively frequency of the strokes of the displacement piston, and specifically in such a way, that after switching on the pump the passageway of the connection channel available for the displaced hydraulic fluid is decreased with every further compression stroke. Instead, it is also possible, and preferentially so, that the control of the closing body is automatic. For this purpose the arrangement is such that the movable closing body is actuatable by the pulsating oil flow during pump compression stroke and gradually movable after the pump is switched on from an open starting position into a closed operating position. In further developments of the invention provisions can be made that the closing body after the pump is shut off automatically goes back again into its open starting position.

The operating mechanism of the diaphragm pump provided with a starting device according to the invention is such, that the diaphragm pump is switched on and brought up to minimum speed. In this state it does not yet deliver. In the process the hydraulic fluid (stroke volume) displaced by the displacement piston pulsates in the still open connection channel as oil stream more or less pressure-less back and forth, without the diaphragm moving. The diaphragm, which due to the system pressure obtaining in the installation cannot move to the product delivery chamber, migrates toward the rearward pressure chamber side limit cup, respectively already rests against it. This ensures, that the diaphragm during starting is not overstretched. By slowly or also suddenly closing the connection channel with the closing device controlled by the actuating drive or automatically activated, the particular diaphragm pump head is smoothly connected into the pressure system of the installation, so that overall a gentle start under load is brought about without the customarily high breakaway momemtum needing to be overcome and accordingly the pump drive needing to be overdimensioned too much.

As already explained, the closing device can be actuated from the outside with a suitably controlled actuating drive. Preferentially, however, the closing device is designed as automatically operating device, which during the pump compression stroke is activated by the pulsating oil stream after the pump is switched on. In this process, the closing body, which can be a spool valve, piston valve or similar, and which establishes by way of the connection channel the connection between pressure chamber and supply chamber, is in starting position when the pump is turned on. Through a proportioning valve, which can also be replaced by a narrow bore respectively a choke, a storage chamber provided at the front face end, in particular at the upper end of the closing body is—due to the defined flow resistances in the connection channel—slowly filled in the rhythm of the stroke. The closing body in the process migrates against the spring force downward and closes the connection channel. Its stable final position is the operating position. When the diaphragm pump is shut down the spring presses the closing body against the occurring leakage flow back into the open starting position. Consequently, during standstill of the diaphragm pump the pressure chamber is in continous open connection with the storage chamber for the hydraulic fluid. When the diaphragm pump takes up operation again, the entire hydraulic volume displaced by the displacement piston is led back into the storage chamber through the starting device (connection channel including open closing device) without significant pressure increase.

The slight excess pressure obtaining in the pressure chamber during the compression stroke brings about—in the case of the automatically operating starting device—the step-wise migration movement of the closing body, which—with each further compression stroke—decreases the passageway of the connection for the displaced hydraulic fluid. Through the increased pressure loss in the passageway of the connection channel the pressure in the pressure chamber rises step-wise, and specifically for so long until the closing body blocks the passageway of the connection channel completely, at which point the pump has reached discharge pressure.

After the pump is turned off the closing body migrates in the already described manner in short time—due to its spring load or due to its inherent weight—into the starting position and unblocks again the connection between the pressure chamber and the storage chamber.

The starting device can be designed so, that it without outside intervention only due to the pressure change in the pressure chamber upon the pump being started, closes automatically the connection to the storage chamber and automatically opens this connection again after the pump is turned off for the next starting process.

Through appropriate design of the closing body as well as the flow resistances of the individual sections of the connection channel, the starting characteristic of the diaphragm pump can readily be adapted to the peculiarities of the pump drive.

In order to exclude the influence of process tolerance, stroke frequencies of the displacement piston and viscosity of the hydraulic fluid, it is, furthermore, possible—as already explained—to carry out actuation of the closing body through electrically, hydraulically, or pneumatically operating actuation drives from the outside, and specifically, independent of the process of pressure changes in the pump. In this manner different starting characteristics can be realized.

Consequently, the overall advantages of the invention can be seen in that

- expensive and noise-intensive starting circuits on the discharge side of the pump can be omitted,
- operating errors in each instance are excluded,
- that the pump drive can be layer out for the operating conditions, such as nominal torque, nominal current etc., and especially with a variable speed pump drive considerable savings in the purchase as well as the operationg of the pump being given,
- coupling, gearing, and pump can be operated without operating starting impacts which might decrease the operating life,
- hydrodynamic friction bearings are stressed only after a lubricating film capable of bearing has built up, and
- that due to the flexibility of the starting device the start-up response of the pump can be adapted to the peculiarities of the drive.

Figure 2:
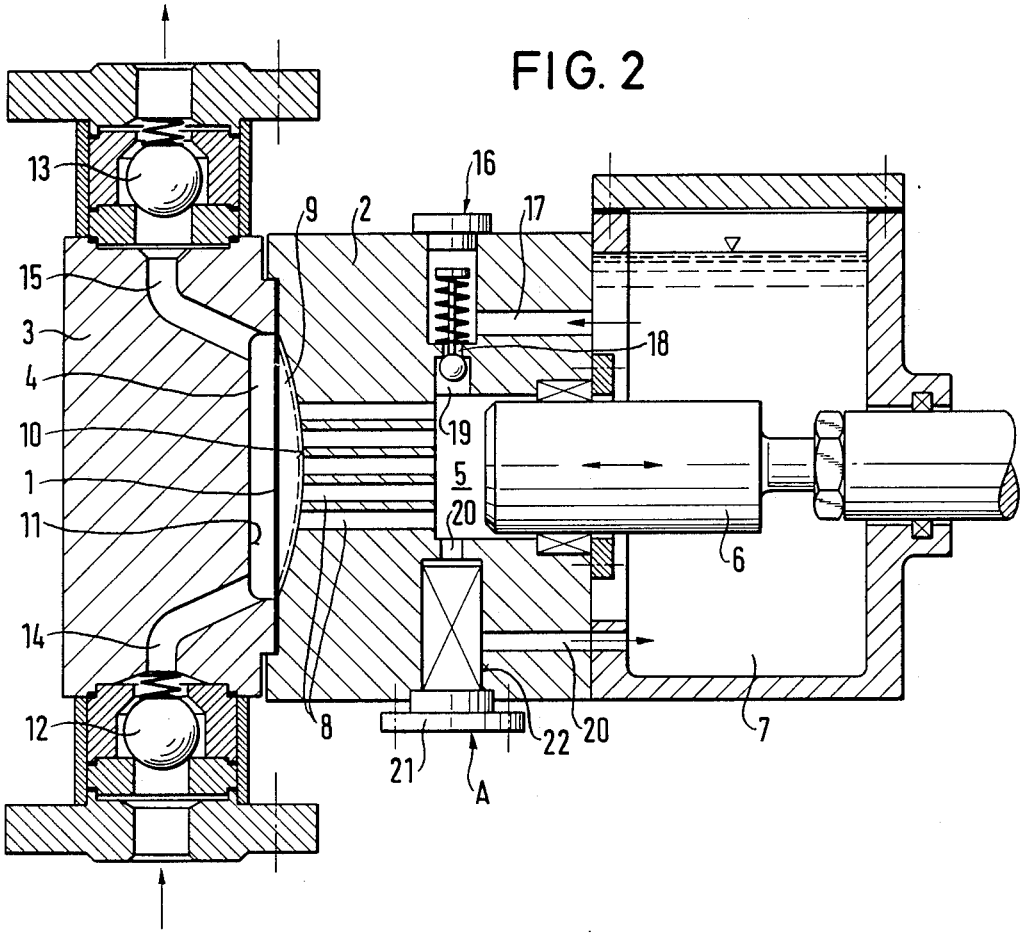
Figure 3:
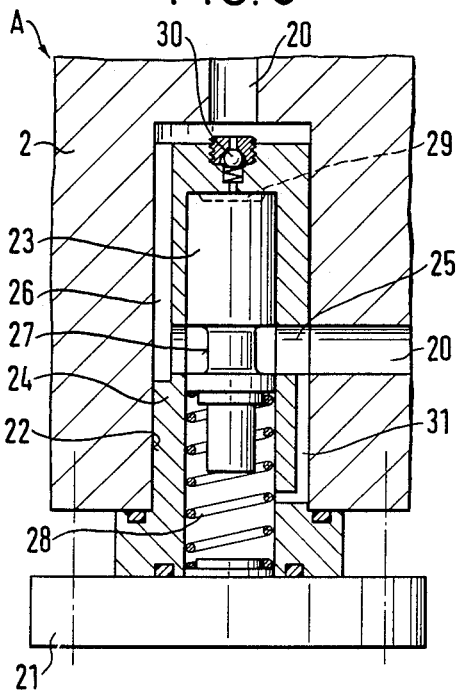
Figure 4:
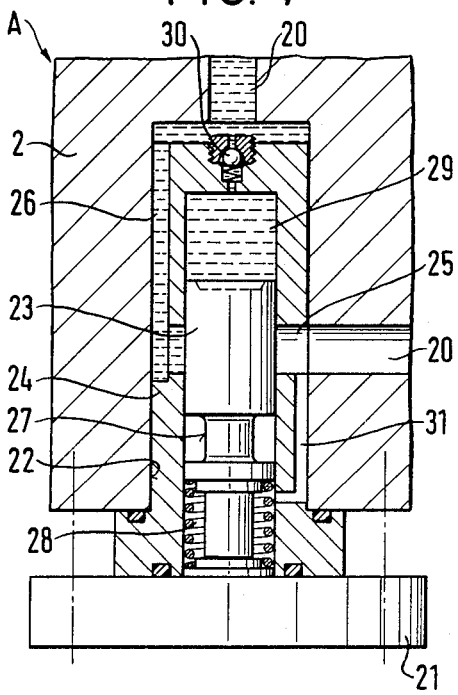
Figure 5:
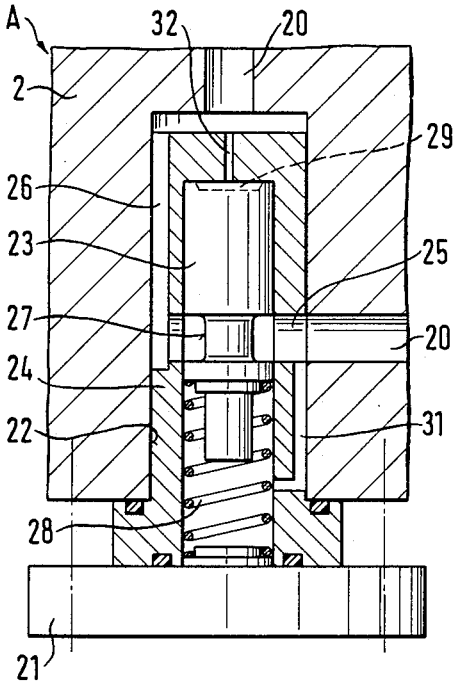

Below, the invention is explained in greater detail in the form of several embodiments in conjunction with the drawing, in which:

FIG. 1 shows schematically in diagrammatic form the typical shape of a torque characteristic over the speed for a three-cylinder pump—without as well as also with starting device;

FIG. 2 in longitudinal section a diaphragm pump provided with the starting device according to the invention;

FIG. 3 detail A according to FIG. 2 magnified in section with the represented starting device having a flap valve as closing body with spool valve being in starting position, and FIG. 4 with spool valve being in operating position;

FIG. 5 a modified model in starting position, and

Figure 6:
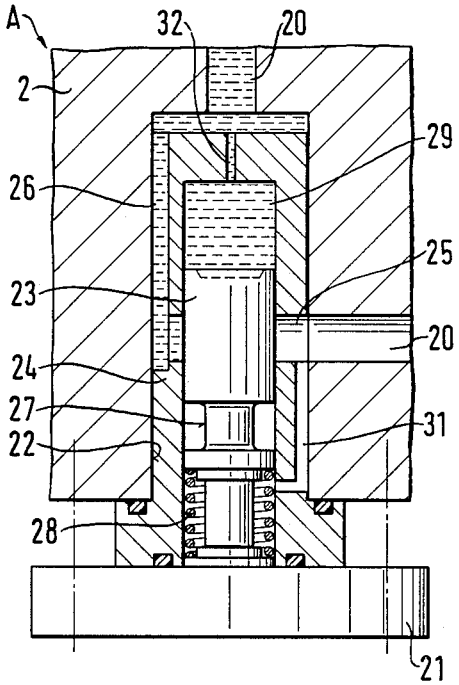
Figure 7:
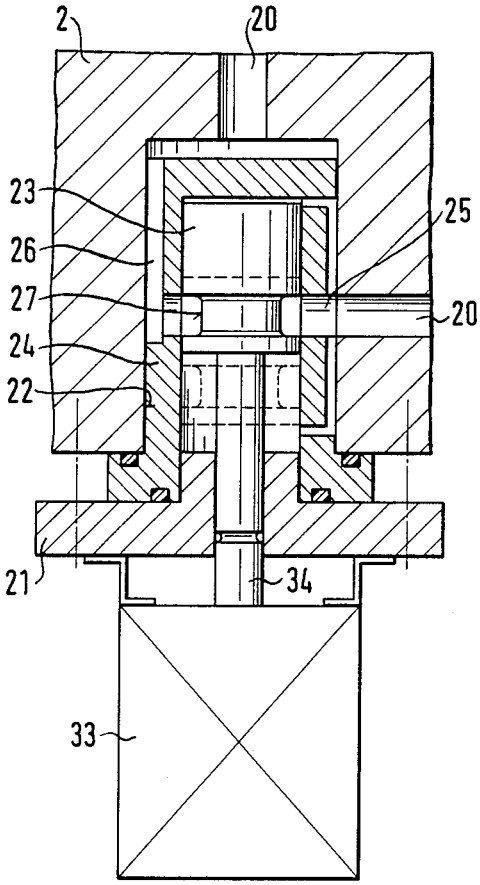
Figure 8:
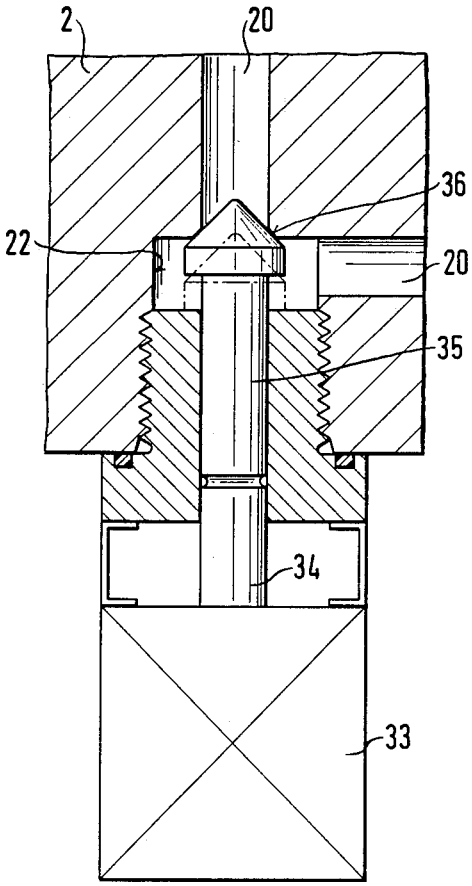
Figure 11:
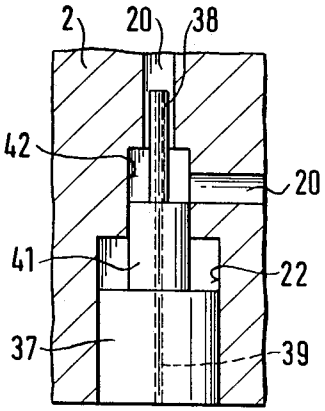
Figure 10:
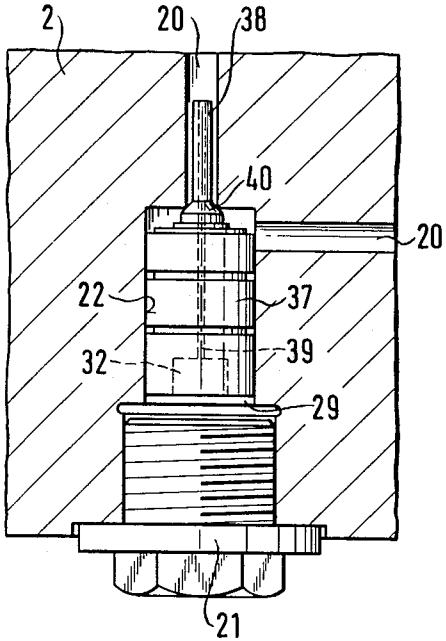
Figure 9:
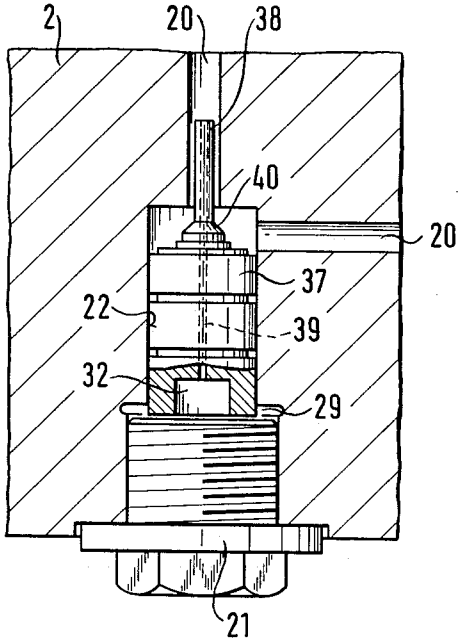

FIG. 6 in operating position;

FIG. 7 a further modified model, with the actuation of the closing device taking place through an actuating drive, with a spool valve as closing body, and FIG. 8 a further modified model with a valve as closing body;

FIG. 9 a further modified model with a storage chamber arranged at the lower end of the closing body, in starting position and FIG. 10 in operating position as well as FIG. 11 a further modification using a slide instead of a valve.

As evident in FIG. 1, the typical torque speed characteristic for, for example, a three-cylinder pump having nostarting device, is such that it has a high starting momentum, the so-called breakaway momentum, which is nearly twice the nominal momentum. Compared to it, the dashed line shows the considerably reduced breakaway momentum of a diaphragm pump provided with a starting device according to the invention, so that, accordingly, the pump drive at most needs to be layed out for the nominal momentum respectively full load momentum.

As can be seen in FIG. 2, the starting device is provided in a hydraulic diaphragm pump, which has a conventional diaphragm 1. The latter is clamped at its edge between a pump body 2 as well as a pump cover 3 detachably fastened to it on the front face and separates a delivery chamber 4 from a pressure chamber 5 filled with a hydraulic fluid. The shown diaphragm pump has an hydraulic diaphragm drive in the form of an oscillating displacement piston 6, which is displaceable in the pump body 2 sealed between the pressure chamber 5 and a storage chamber 7 for the hydraulic fluid. The pressure chamber 5 on the piston side is connected through several axial bores 8 arranged in the pump body 2 with a pressure chamber 9 on the diaphragm side, which is limited on the one hand by diaphragm 1 as well as, on the other hand, by a rearward (piston-side) cup 10. The diaphragm 1 lies against this rearward limiting cup 10 at the end of the intake stroke, as shown in dashed lines in FIG. 2, while at the end of the compression stroke it comes to rests on a foreward limiting cup 11.

The front limiting cup 11 is formed in the pump cover 3, which—in customary manner—has a spring-loaded inlet valve 12 as well as a spring-loaded outlet valve 13. These two valves 12, 13 are connected by way of an inlet channel 14 as well as an outlet channel 15 with the delivery chamber 4 in such a way, that the pumping medium during the intake stroke toward the right according to FIG. 2 of the displacement piston 6 and, hence, the diaphragm 1 is taken in in the direction of the arrow into the pumping chamber 4 through the inlet valve 12 and the inlet channel 14. During the compression stroke of diaphragm 1—taking place toward the left according to FIG. 2—the pumping medium is then pressed out proportioned through the outlet channel 15 and the outlet valve 13 in the direction of the arrow from the discharge chamber 4.

In order to avoid at the end of the intake stroke overloading the diaphragm 1 as well as the occurrennce of cavitations, a conventional spring-loaded blow valve 16 is provided, which is connected through channels 17, 18, 19 with the pressure chaber 5 respectively 9 and the storage chamber 7.

The starting device A provided in the described diaphragm pump has a connection channel 20, which extends between pressure chamber 5 as well as storage chamber 7 and is closable after the pump has started to be operated by a closing body to be described in more detail below. The closing body is displaceable in a connecting bore 22 accessible from the outside and closed by a stopper 21, which is arranged in a bend of the connection channel 20 in such a way, that the section of the connection channel 20 on the pressure chamber side ends in the floor of the connecting bore 22 and the storage chamber side section of connection channel 20 ends in the side wall of the connecting bore 22.

Different constructional embodiments of the starting device A consisting essentially of the connection channel 20 and closing body cooperating with it are explained in detail below in conjunction with FIGS. 3 to 11.

In the embodiment according to FIGS. 3 and 4 the starting device has as closing body a spool valve 23, which is displaceable in the connecting bore 22, and specifically within a sleeve 24 set into it. The sleeve 24 is provided with a transversely extending through bore 25 and a longitudinal channel 26 such, that the flow connection between the section of the connection channel 20 on the pressure chamber side and the storage chamber side section is maintained. At a given site on its circumference the spool valve 23 has a peripheral groove 27 such that the connection channel 20 when the spool valve 23 is in starting position according to FIG. 3 is open, however, when the spool valve is in operating position according to FIG. 4 is closed. Between the lower end of the spool valve 23 and the sealing stopper 21 a spring 28 braces itself in the insert sleeve 24, which prestresses the spool valve 23 in the direction of its starting position. Between the upper front face end of the spool valve 23 and the floor of the sleeve 24 a storage chamber 29 is bounded, which is connected by way of a valve device with the pressure chamber side section of the connection channel 20 and can be filled with hydraulic fluid. In the represented embodiment this valve device is designed as flap valve respectively as spring-loaded proportinoning valve 30, which essentially opens only during the compression stroke of the displacement piston 6, however, remains closed during the intake stroke of the displacement piston 6.

As already explained the spool valve 23, which establishes the connection by way of connection channel 20 and the channels 25, 26, 27 acting with it between the pressure chamber 5 and the storage chamber 7, when the pump is switched on is in the starting position according to FIG. 3, in which it is held by spring 28. When the pump is brought up to minimum speed the oil displaced by the displacement piston 6 pulsates in the open connection channel 20 back and forth. In the process, during the compression stroke of the displacement piston 6 in the pressure chamber 5 a slight excess pressure forms, which due to the defined flow resistances in channels 20, 25, 26, and 27 effects that with each compression stroke the proportioning valve 30 opens in the direction of the fillable storage chamber 29 and the storage chamber 29 is slowly filled in the rhythm of the strokes. The spool valve, consequently, migrates downward against the force of spring 28, so that the peripheral groove 27 also provided in the spool valve 23 moves away from the connection channel 20 on the storage chamber side. This decreases the passageway of the connection channel 20, and that specifically for so long until the spool valve 23 has shifted completely downward into the operating position according to FIG. 4, in which the connection channel 20 is completely closed. In this position the pump has reached discharge pressure, so that the diaphragm pump head is connected to the pressure network of the installation.

As can be clearly seen in FIGS. 3 and 4, for the sake of completeness it should be pointed out that the sleeve chamber below the spool valve 23, which receives spring 28, is connected via a throughlet 31 with the storage chamber-side section of the connection channel 20.

In the modified model according to FIGS. 5 and 6 instead of the proportioning valve 30 a choke 32 in the form of a narrow bore is provided, which exerts the same effect as the proportioning valve 30, specifically insofar that during compression stroke of the displacement piston 6 the storage chamber 29 located above the spool valve 23 is filled with hydraulic fluid, so that the spool valve 3 against the force of the spring 28 moves step-wise in the rhythm of the stroke downward and in the process interrupts the connection between the two sections of the connection channel 20.

In the model according to FIG. 7 actuation of the spool valve 23 takes place with an actuation drive 33, which can be actuated in turn electrically, magnetically or pneumatically. For this purpose the actuation drive 33 applied on the outside of the sealing stopper 21 of the connecting bore 22 is connected with the spool valve 23 by way of an actuation tappet 34, so that the spool valve 23 corresponding to the stroke rhythm of the displacement piston 6 can be displaced downward from its starting position, in which the connection channel 20 is open, into its operating position, in which the connection channel 20 is closed.

In the further modified model according to FIGS. 9 and 10 the closing body arranged in the connecting bore 22 is formed as freely movable piston valve 37, the piston rod 38 of which projects into the pressure chamber side section of the connection channel 20. The fillable storage chamber 29, which brings about the automatic displacement of the piston valve 37 is located below the piston valve 37, as can be clearly seen in FIGS. 9 and 10. Here, the connection of the storage chamber 29 with the pressure chamber-side section of the connection channel 20 takes place through a longitudinal center bore 39 provided in the piston valve 37. At the end of this longitudinal center bore 38 ending in the storage chamber 29 a choke 32—similar to that according to FIGS. 5 and 6—is provided. In its place a flap valve—similar to the proportioning valve 30 according to FIGS. 3 and 4—can be provided, which opens with each compression stroke of the displacement piston 6 in the direction of the storage chamber 29 and fills it with hydraulic fluid. In each case this lifts the piston valve 37 from its starting position according to FIG. 9, in which the connection channel 20 is completely open, into its operating position according to FIG. 10, in which the connection between the two sections of the connection channel 20 is completely interrupted. In this position a valve cone 40, which is formed at the connection site between piston rod 38 and upper end of the piston valve 37, lies against an associated valve seat—similar to the valve seat 36 according to FIG. 8. After the pump is switched off the piston valve 37 again due to its inherent weight sinks slowly into the starting position according to FIG. 9, since the storage chamber 29 gradually empties due to the leakage flow in the piston gap as well as due to the backflow occuring in the longitudinal center bore 39.

As is apparent in FIG. 11, it is, lastly, possible, to provide instead of the valve cone 40 arranged at the upper end of the piston valve 37 a slide 41, which controls in a narrowed portion 42 of the connecting bore 22 the connection between the two section of the connection channel 20.

Regarding features of the invention not explained in greater detail above, reference is made expressly to the drawing as well as the claims.

We claim:

1. Method for starting an hydraulic diaphragm pump against load, with the actuation of a diagphram separating a delivery chamber from an hydraulic pressure chamber taking place by an oscillating displacement piston, which is displacable between the pressure chamber and an hydraulic supply, characterized in that upon pump start-up a stroke volume of the hydraulic fluid is transported by the displacement piston in an open connection path between pressure chamber and supply chamber and that, subsequently, the motion of the diaphragm is coupled to the displacement of the displacement piston in that the connection between pressure chamber and supply chamber is interrupted.

2. Method as stated in claim 1, characterized in that the stroke volume of the hydraulic fluid circulates in the connection path between pressure chamber and supply chamber.

3. Method as stated in claim 1, characterized in that the stroke volume of the hydraulic fluid in the connection path between pressure chamber and supply chamber due to the displacement piston flows such, that it pulsates.

4. Method as stated in claim 1, characterized in that the interruption of the connection between pressure chamber and supply chamber is controlled.

5. Method as stated in claim 1, characterized in that the interruption of the connection between pressure chamber and supply chamber takes place automatically.

6. Method as stated in claim 5, characterized in that the interruption of the connection between pressure chamber and supply chamber is brought about by the excess pressure of the hydraulic fluid occurring in the pressure chamber during the compression stroke.

7. An apparatus comprising a diaphragm pump being provided with at least one diaphragm (1), which separates a delivery chamber (4) from a pressure chamber (5) filled with hydraulic fluid, is clamped at its edge between the pump body (2) and a pump cover (3), and with a hydraulic diaphragm drive in the form of an oscillating displacement piston (6), which is displaceable between the pressure chamber (5) and a supply chamber (7) for the hydraulic fluid, characterized in that on the pump drive side between the pressure chamber (5) and the supply chamber (7) a connection channel (20) is provided, which following pump start-up guides the hydraulic fluid displaced in the pressure chamber (5) by the displacement piston (6) back and which in the course of the further strokes of the displacement piston (6) is closable by a controlled closing unit (A), so that the pressure in the pressure chamber (5) increases to the level of the discharge pressure.

8. An apparatus of claim 7, characterized in that the closing unit (A) has a movable closing body (23; 35, 36; 37), which is displaceable between a starting position, in which it clears the passageway of the connection channel (20), and an operating position, in which the passagway of the connection channel (20) is closed.

9. An apparatus of claim 7, characterized in that the closing body is a valve (35, 36), the valve body (35) of which cooperates with a valve seat (36) formed in the connection channel (20).

10. An apparatus of claim 7, characterized in that the closing body is a spool valve (distributing slide) (23), which is arranged in the flow path of the connection channel (20) and—by way of a through channel (27) controls the size of the passageway of the connection channel (20).

11. An apparatus of claim 7, characterized in that the closing body is a control piston (37).

12. An apparatus of one of claim 7, characterized in that the closing body (23; 35, 36; 37) is displaceable in a connecting bore (22) accessible from the outside.

13. An apparatus of claim 12, characterized in that the connecting bore (22) is arranged in a bend of the connection channel (20) in such a way that the connection channel (20) section on the pressure chamber side ends in the floor of the connecting bore (22) and the connection channel (20) section on the side of the supply chamber ends in the wall of the connecting bore (22).

14. An apparatus of claim 7, characterized in that the control of the closing body (23; 35, 36) takes place from the outside with an actuating drive (33).

15. An apparatus of claim 14, characterized in that the actuating drive (33) operates as a function of the number respectively frequency of the strokes of the displacement piston (6) in such a way that after switching on the pump the passageway of the connection channel (20) available for the displaced hydraulic fluid is decreased with each additional compression stroke.

16. An apparatus of claim 7, characterized in that control of the closing body (23; 37) takes place automatically such, that it is actuatable by the pulsating oil flow on pump compression stroke and after the pump is switched on is gradually movable from its open starting position into the closed operating position.

17. An apparatus of claim 16, characterized in that the closing body (23; 37) bounds with its one front face end a storage chamber (29) formed in the connecting bore (22), which through a valve device (30, 32) is connected to the section of the connection channel (20) on the pressure chamber side and with each compression stroke of the displacement piston (6) can be filled with hydraulic fluid.

18. An apparatus of claim 16, characterized in that the chargeable storage chamber (29) is arranged at the upper end of the closing body (23), with the closing body (23) being prestressed by a spring (28) in the direction of its open starting position.

19. An apparatus of claim 16, characterized in that the chargeable storage chamber (29) is arranged below the closing body (37), with the valve device (30, 32) connected by way of a longitudinal center bore (39) formed in the closing body (37) to the pressure chamber side part respectively section of the connection channel.

20. An apparatus of claim 16, characterized in that the valve device is a flap valve (30), which during the compression stroke of the displacement piston (6) opens toward the fillable supply chamber (29).

21. An apparatus of claim 16, characterized in that the valve device is a choke (32).

* * * * *